US005383239A

United States Patent [19]

Mathis et al.

[11] Patent Number: 5,383,239

[45] Date of Patent: Jan. 24, 1995

[54] SELF-CLEANING WHIRLPOOL SYSTEM

[76] Inventors: Cleo D. Mathis, 16209 Santa Bianca, Hacienda Heights, Calif. 91745; Jeff C. Henry, 2952 Pineview St., Duluth, Ga. 30136

[21] Appl. No.: 118,263

[22] Filed: Sep. 9, 1993

[51] Int. Cl.[6] ..... E03C 1/046; B03B 3/08

[52] U.S. Cl. ..... 4/541.1; 4/490; 4/541.3; 134/169 R; 134/169 C

[58] Field of Search ..... 4/490, 541.1–541.6, 4/546, 538; 134/169 R, 169 C, 166 R, 166 C; 251/83

[56] References Cited

U.S. PATENT DOCUMENTS

| | | | |
|---|---|---|---|
| 3,166,743 | 1/1964 | Sparr | 134/169 C |
| 3,228,611 | 1/1966 | Russell | 134/166 C |
| 4,383,341 | 5/1983 | Altman | 4/662 |
| 4,857,112 | 8/1989 | Franninge | 4/541.1 |
| 4,858,632 | 8/1989 | Jay, Jr. et al. | 134/169 R |
| 4,868,934 | 9/1989 | Altman | 4/546 |
| 4,954,179 | 9/1990 | Franninge | 4/541.1 |
| 4,979,245 | 12/1990 | Gandini | 4/542 |
| 5,012,535 | 5/1991 | Klotzbach | 4/541 |
| 5,029,594 | 7/1991 | Pierce, Jr. | 134/100 |
| 5,109,880 | 5/1992 | Booth | 134/169 C |

FOREIGN PATENT DOCUMENTS

| | | | |
|---|---|---|---|
| 519572 | 12/1992 | European Pat. Off. | 4/541.3 |
| 3826001 | 2/1990 | Germany | 4/541.3 |

*Primary Examiner*—Henry J. Recla
*Assistant Examiner*—Gregory Vidovich
*Attorney, Agent, or Firm*—Cushman, Darby & Cushman

[57] ABSTRACT

A self-cleaning system and method for a whirlpool includes a whirlpool basin having inner and outer surfaces, a drain, closable nozzles for introducing a water-/air mixture into the basin, a water circuit, an air circuit, and a one-way valve that couples the water circuit and the air circuit. Hot and/or cold water sources are connected to the air circuit for introducing water into the basin via the air circuit, the one-way valve, the water circuit, and the opened nozzles. A detergent dispensing unit is also connected to the air circuit for use during a self-cleaning mode. In a whirlpool mode, hot and/or cold water is introduced into the basin by water flow through the air circuit, the one-way valve, and the water circuit. Water is withdrawn from the basin through an inlet into the water circuit, mixed with air provided from the air circuit, and reintroduced into the basin under pump-supplied pressure as a water/air mixture. In the self-cleaning mode, the nozzles are closed to isolate the interior of the basin from the air and water circuits. Hot and/or cold water and detergent from the detergent dispensing unit flow through the air circuit, the one-way valve, the water circuit, the pump, and into the basin for discharge through the drain to thereby effect cleaning.

7 Claims, 2 Drawing Sheets

SELF-CLEANING WHIRLPOOL SYSTEM

BACKGROUND OF THE INVENTION

The present invention relates to a whirlpool system for spas, hot-tubs, and the like which is capable of flushing and sanitizing the water and air circulating system after use.

Whirlpool tubs, spas, hot-tubs, and the like are commonly provided for use at hotels, resorts, and in homes. Typically, the tubs are filled with water and, during the whirlpool mode, a portion of the water is drawn into a pump which recirculates water back into the tub through nozzles located below the water level. The tub is then drained after the whirlpool massage is completed.

However, with repeated use by multiple users, contaminate such as dirt, skin particles, and body oils may accumulate in the circulation pipes, nozzles and fittings, causing bacteria growth. Thus, when subsequently operated in the whirlpool mode, these contaminates may be emitted directly into the tub causing a cleanliness problem. Further, the deposits may also emit unpleasant odors after a prolonged period of time.

The conventional method of cleaning the whirlpool system is to fill the tub with a mixture of water and detergent and then operate the system in the whirlpool mode for an extended period of time. The water and detergent circulates through the pipes so as to sanitize the circulating system. A rinse cycle is then required to remove the detergent from the circulating system. Thereafter, the interior surface of the tub must be thoroughly cleaned to remove any residue resulting from the cleaning of the circulating system. The conventional cleaning method thus requires a significant amount of time, energy, and water, making it costly to clean the tub after every use.

SUMMARY OF THE INVENTION

It is an object of the present invention to provide a self-cleaning whirlpool system which is capable of operating in a cleaning mode so as to flush the air and water circulation pipes without the necessity of filling the entire tub with water and detergent.

This objective is achieved by providing a self-cleaning system for a whirlpool. The whirlpool includes a basin, a drain provided in a bottom portion thereof, and water inlets coupled to a water supply. The system includes a water circuit supported on the outer surface of the basin. The water circuit includes a plurality of nozzle assemblies disposed in a spaced relationship which communicate with the inner-surfaces of the basin. The water circuit also includes a water intake opening disposed near the bottom portion of the basin. The system includes an air circuit having at least one air intake and supported on the outer surface of the basin. The air circuit cooperates with the water circuit so as to direct ambient air through the air intake opening to be mixed with water in the water circuit so that the mixture of air and water may be discharged through the nozzles during a whirlpool mode of operation. A pump is also provided which is operatively coupled to the water circuit. The system further includes a detergent dispensing conduit having first and second ends. The first end is operatively coupled to the air circuit; the second end is accessible from an exterior portion of the basin. A valve is disposed within a portion of the air circuit so as to prevent water from entering into the air circuit during the whirlpool mode of operation and to permit a water and detergent mixture to enter the water circuit from the air circuit during a cleaning mode of operation. When operating in a cleaning mode, the air intake opening and nozzles are closed so as to isolate the basin from the air and water circuits. Detergent is introduced into the second end of the detergent conduit and mixed with fresh water from the water inlets. The mixture of water and detergent is directed into the air circuit, through the valve and the water circuit, through the pump and the water intake opening, and out through the drain, thereby flushing the system.

Other objects, feature and characteristics of the present invention, as well as the methods of operation and functions of the related elements of the structure, and the combination of the parts and economics of manufacture will become more apparent upon consideration of the following detailed description and appended claims with reference to the accompanying drawings, all of which form a part of this specification.

DETAILED DESCRIPTION OF THE PREFERRED EMBODIMENT

Figure 1:
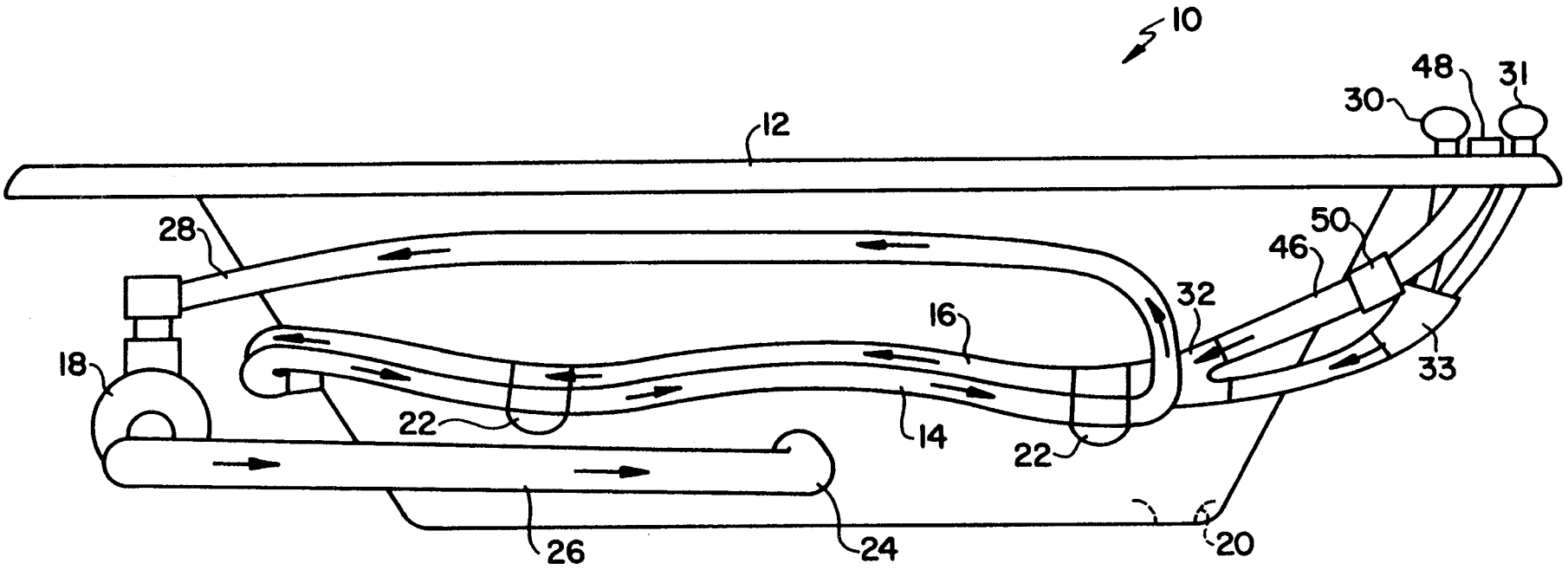
FIG. 1 is a front elevation, schematic view of a whirlpool system provided in accordance with the principles of the present invention.

As shown in FIG. 1, a preferred embodiment of a self-cleaning whirlpool system in accordance with the principles of the present invention is designated generally by the reference character 10. As shown, the self-cleaning whirlpool system 10 includes a basin 12, a water circuit 14, and an air circuit 16, each mounted to the periphery of the basin 12, and a circulation pump 18.

The basin 12 is defined by inner and outer surfaces and includes a drain 20 at the bottom portion thereof.

Figure 2:
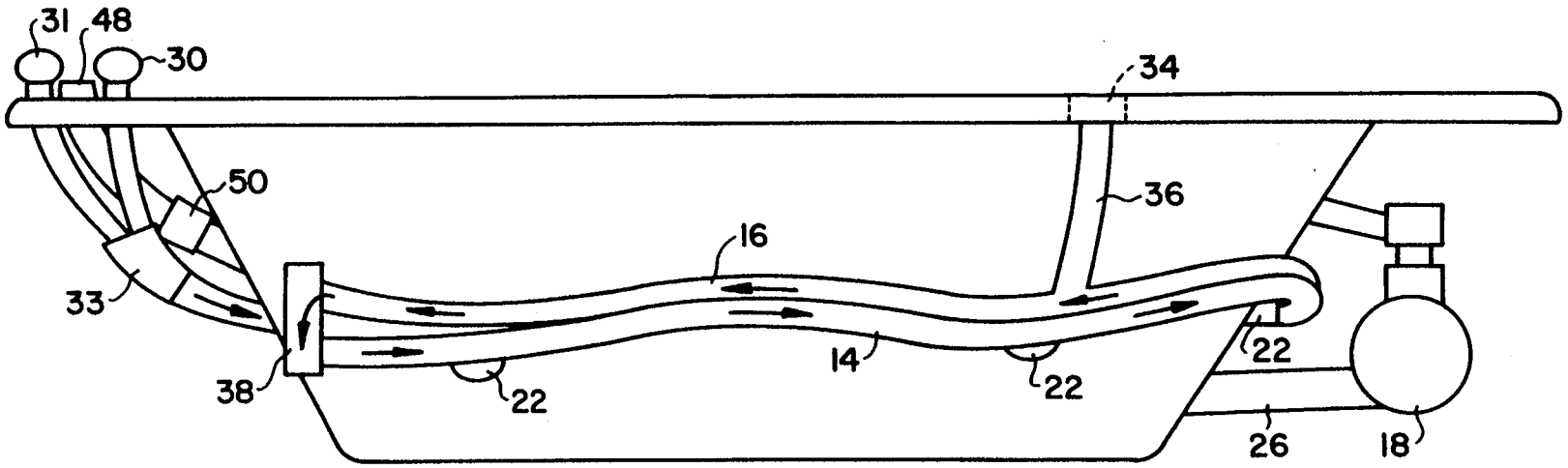
FIG. 2 is a rear elevation, schematic view of the whirlpool system shown in FIG. 1.

As shown in FIGS. 1 and 2, the water circuit 14 is mounted to the exterior or outer surfaces of the basin 12 and includes a series of spaced, conventional nozzle assemblies 22 mounted to the side walls of the basin 12 for introducing a mixture of air and water into the basin 12, as will become apparent below. The nozzle assemblies 22 may be opened so as to communicate with the interior of the basin 12 or may be closed so as to isolate the interior of the basin from the water and air circuits 14 and 16. A water intake 24 is provided in a side wall portion of the basin 12 near its bottom. A water intake pipe 26 is coupled to the water intake 24 at one end thereof. The other end of the intake pipe 26 is coupled to the intake of an electrically powered circulation pump 18. A water line 28 is coupled to the pressure side of the circulation pump 18, which completes the water circuit.

In the illustrated embodiment, the air circuit 16 is mounted above the water circuit 14 on the outer surfaces of the basin 12. The air circuit 16 is also coupled to the hot and cold water supply inlets, 30 and 31, via a Y-fitting 32. The hot and cold water is coupled to water supply lines and is directed through a valve 33. The valve 33 is preferably a check valve permitting water to flow only in one direction. Accordingly, water cannot flow back toward the hot and cold water inlets 30 and 31. The valve 33 also permits the hot and cold water to mix prior to entering the air circuit 16 and thus, the basin 12. Thus, when filling the basin 12, water flows into the air circuit 16 and out through the open nozzle assemblies 22, as will be explained in more detail below.

The air circuit 16 includes at least one air intake valve 34 (FIG. 2) disposed near the upper rim of the basin 12. The air intake valve 34 takes-in ambient air which moves through conduit 36 and through the air circuit 16. The air intake valve 34 is preferably a check valve which permits air flow therethrough when the system is operating in the massage mode, but prevents fluid to flow therethrough in a direction opposite to the air flow direction during the cleaning mode of operation. Thus, during the massage mode, the ambient air in the air circuit mixes with water in the water circuit 14 and is delivered to the interior of the basin 12 via the nozzle assemblies 22.

Figure 3:
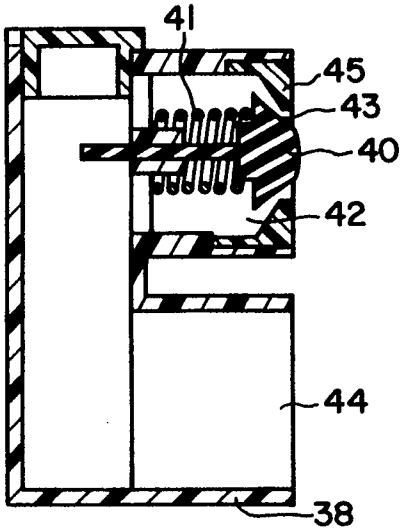
FIG. 3 is an enlarged cross-sectional view of a one-way valve of the whirlpool system provided in accordance with the principles of the present invention.

A valve assembly 38 (FIG. 2) couples the air circuit 16 and the water circuit 14. As shown in FIG. 3, the valve assembly 38 includes a one-way valve member 40 which is disposed within the air circuit 16 and is normally closed by a resiliently biased spring 41 so water will not enter the air circuit 16 during the massage or whirlpool operating mode of the system 10. When the valve member 40 is in the closed position, sealing surface 43 engages its cooperating surface 45. During a cleaning mode of operation, pressure within the air circuit 16 compresses the spring 41 causing the one-way valve member 40 to open, thus, moving the valve member so that surface 43 is no longer in sealing contact with surface 45. When the valve member 40 is open, the inlet side of valve member 40 communicates with the chamber 42, which, in turn, communicates with chamber 44, so that the air circuit 16 communicates with the water circuit 14, as will become apparent below.

The operation of the system in the massage mode will be appreciated with reference to FIGS. 1 and 2. First, the hot and cold water supply inlets, 30 and 31, are opened to direct water through the air circuit 16, through the nozzle assemblies 22, and into the basin 12 to fill the basin. Once the basin 12 is filled to the appropriate level, the hot and cold water supply inlets, 30 and 31, are closed. Thus, in the illustrated embodiment, the basin 12 is advantageously filled through the nozzle assemblies 22, which eliminates the need for a costly faucet and fittings. With the nozzle assemblies 22 submerged, the pump 18 is started to cause water to be drawn-in through the water intake 24, through the pump 18, and through the water circuit 14. Ambient air enters the air circuit 16 through the air intake valve 34 and is entrained with the water flowing in the water circuit 14 at the nozzle assemblies 22. The air and water mixture is then expelled into the basin 12 through the nozzle assemblies 22. The pump 18 is shut-off when massaging is complete, and the water is drained from the basin 12.

The invention provides a system for cleaning the air and water circuits upon completion of the massage mode. Thus, in accordance with the principles of the present invention, the system 10 further includes (FIG. 1) a detergent conduit 46, having one end thereof coupled to the air circuit 16 at the Y-fitting 32. The other end of the detergent conduit 46 is coupled to the basin 12, preferably between the hot and cold water supply inlets, 30 and 31. A cover member 48 caps the detergent conduit 46. A check valve 50 permits liquid detergent to flow toward and into the Y-fitting 32, but prevents fluid flow in an opposite direction.

The operation of the whirlpool system 10 in the cleaning mode will be appreciated with reference to FIGS. 1 and 2. To initiate the cleaning mode, the nozzle assemblies 22 are closed. Air intake valve 34 will prevent fluid flow therethrough from the air circuit 16. Thus, the air circuit 16 and water circuit 14 are isolated from the interior of the basin 12. The hot and cold water supply inlets, 30 and 31, are then opened. The cover member 48 is removed, and a detergent including, for example, a fungicide and/or a bactericide is poured into the detergent conduit 46. The detergent mixes with the water and is sent through the air circuit 16 as shown by the flow direction arrows in FIGS. 1 and 2. Pressure within the air circuit 16 causes one-way valve member 40 to open permitting the detergent and water mixture to enter the water circuit 14. The mixture then flows through pump 18, through the water intake line 26, through the intake opening 24, and into the basin 12 to be drained therefrom. Thus, during the cleaning mode, the air circuit 16, water circuit 14 and pump 18 are all flushed with the detergent and water mixture. Accordingly, fungi and dirt-causing bacteria are flushed from the system 10.

Upon completing the cleaning mode, the nozzle assemblies 22 are opened so that the system 10 is ready to function in the massage mode once again.

From the foregoing, it can be appreciated that the self-cleaning whirlpool system 10 provides an inexpensive, yet effective way to sanitize the circulation system of a whirlpool tub to eliminate bacteria growth therein.

While the invention has been described with connection with what is presently considered to be the most practical and preferred embodiment, it is understood that the invention is not limited to the disclosed embodiment but, on the contrary, is intended to cover various modifications and equivalent arrangements included within the spirit and scope of the appended claims.

What is claimed is:

1. A self-cleaning system for a whirlpool, the whirlpool including a basin defined by inner and outer surfaces, a drain defined in a bottom portion of the basin, a water intake opening disposed near the bottom portion of the basin, and water inlets coupled to a water main, the system comprising:

a water circuit adapted to be supported on the outer surface of the basin, the water circuit including a plurality of nozzles disposed in a spaced relation, the nozzles communicating with the inner-surfaces of the basin when disposed in an open position, the water circuit adapted to be coupled to the water intake opening;

an air circuit adapted to be supported on the outer surface of the basin, the air circuit including at least one air intake opening adapted to be coupled to the basin, the air circuit being cooperable with the water circuit so as to direct ambient air through the air intake opening to be mixed with water in the water circuit so that the mixture of air and water may be discharged through the nozzles during a whirlpool mode of operation;

a pump adapted to be operatively coupled between the water circuit and the water intake opening;

a detergent dispensing conduit having first and second ends, the first end being operatively coupled to the air circuit, the second end being accessible from an exterior portion of the basin; and a valve disposed within a portion of the air circuit so as to prevent water from the water circuit from entering into the air circuit during the whirlpool mode of operation and to permit a water and detergent mixture to enter the water circuit during a cleaning mode of operation, whereby in the cleaning mode of operation, the air intake opening and nozzles are closed so as to isolate the inner surfaces of the basin from the air and water circuits, detergent introduced into the second end of the detergent conduit being mixed with fresh water from the water inlets, the mixture of water and detergent being directed into the air circuit, through the valve and water circuit, through the pump and the water intake opening and out through the drain, thereby flushing the system.

2. The system as defined in claim 1, wherein the valve is a one-way valve includes a movable valve member and a spring member, the spring member normally biasing the valve member so as to be in a closed, sealed position, the spring member being adapted such that pressure in the air circuit during the cleaning mode of operation causes the spring to compress, permitting the valve member to move to an open position.

3. The system as defined in claim 1, wherein a high side of the pump is coupled to a portion of the water circuit and a low side of the pump is coupled to a water intake conduit, the water intake conduit being coupled to the water intake opening.

4. The system as defined in claim 1, wherein the second end of the detergent conduit is disposed at a top portion of the basin adjacent the water inlets.

5. The system as defined in claim 1, wherein the nozzles are manually closable.

6. The device as defined in claim 1, wherein a check valve is disposed within the detergent conduit so as to permit the flow of fluid therethrough to be in only one direction.

7. A method of cleaning a whirlpool system, the whirlpool system including a basin defined by inner and outer surfaces, a drain defined in a bottom portion of the basin, a water intake opening disposed near the bottom portion of the basin, water inlets coupled to a water main, a water circuit adapted to be supported on the outer surface of the basin, the water circuit including a plurality of nozzles disposed in a spaced relation communicating with the inner-surfaces of the basin when disposed in an open position, the water circuit adapted to be coupled to the water intake opening, an air circuit adapted to be supported on the outer surface of the basin, the air circuit including at least one air intake opening adapted to be coupled to the basin, a pump adapted to be operatively coupled between the water circuit and the water intake opening, a detergent conduit coupled to the air circuit, the method comprising the steps of:

closing the nozzles and air intake opening to isolate the air and water circuits from the interior of the basin;

directing a mixture of fresh water and detergent into the detergent conduit and into the air circuit;

permitting the mixture to enter the water circuit and pump;

permitting the fluid to exit the pump and be delivered through the water intake opening into the basin;

permitting the basin to continuously drain, thereby flushing the system.

* * * * *